United States Patent [19]

Masse

[11] 4,410,053

[45] Oct. 18, 1983

[54] APPARATUS FOR DRILLING HARD MATERIAL

[76] Inventor: Roger F. Masse, 131, rue Roussin, Thetford Mines, Canada, G6G 1N6

[21] Appl. No.: 216,821

[22] Filed: Dec. 15, 1980

[51] Int. Cl.[3] ..... E21B 1/00; E21B 4/14; E21B 4/16; E21B 4/20

[52] U.S. Cl. ..... 175/53; 175/96; 299/62

[58] Field of Search ..... 175/53, 95, 96, 57, 175/62, 410, 418, 390; 299/62

[56] References Cited

U.S. PATENT DOCUMENTS

| | | | |
|---|---|---|---|
| 732,326 | 6/1903 | Unanue | 299/62 X |
| 900,950 | 10/1908 | Proctor | 175/96 X |
| 1,075,027 | 10/1913 | Ebbley | 299/62 |
| 2,595,126 | 4/1952 | Causey | 175/96 |
| 2,942,850 | 6/1960 | Heath | 175/96 |
| 3,357,507 | 12/1967 | Stewart | 175/418 X |
| 3,387,673 | 6/1968 | Thompson | 175/96 |
| 3,682,258 | 8/1972 | Kelly, Jr. et al. | 175/96 |
| 3,917,009 | 11/1975 | Dyer et al. | 175/53 |

FOREIGN PATENT DOCUMENTS

| | | | |
|---|---|---|---|
| 999884 | 10/1973 | Canada | 175/96 |
| 387281 | 12/1923 | Fed. Rep. of Germany | 299/62 |
| 833334 | 3/1952 | Fed. Rep. of Germany | 175/53 |
| 517693 | 7/1976 | U.S.S.R. | 175/96 |

*Primary Examiner*—Stephen J. Novosad
*Attorney, Agent, or Firm*—Steele, Gould & Fried

[57] ABSTRACT

A method for drilling hard material such as rock by fragmenting the rock by impact in selected spaced-apart areas and simultaneously fragmenting the rock by shear between the selected areas. The invention also covers a drill head with particularly arranged impact hammers for carrying out the method, and a drill unit incorporating the drill head.

11 Claims, 6 Drawing Figures

APPARATUS FOR DRILLING HARD MATERIAL

The present invention relates to improvements in drilling hard material, such as rock.

The invention more particularly relates to an improved drill head for use in drilling relatively large holes, and to a rock drill employing such an improved drill head.

The invention also relates to a novel method for use in drilling relatively large holes.

Several methods are now employed for drilling relatively large holes in hard material, such as rock. In drilling large vertical holes such as ventilation, escape and/or safety shafts in mines, a vertical pivot holes is often drilled first. A chipping drill is then passed upwardly, guided by the pilot hole, to enlarge it. To obtain a large enough hole, however, several costly and time consuming passes must be made using successively larger chipping drills. Even in soft rock, the method is expensive and it does not always work satisfactorily in harder rock.

To drill vertical holes, it is also known to provide a drill head on the end of a drill shaft, which head carries its own drive unit and drills down from the top toward the bottom. Such units however are relatively small and thus only small holes can be drilled.

Another method of drilling large vertical holes comprises first drilling a small pilot hole from the top down, and then pulling a large drilling head upwardly while guiding it by the pilot hole. The drilling head is pulled up by the drill shaft used to drill the pilot hole. The drilling head comprises a cylindrical base having substantially the size of the large hole to be drilled and carrying a plurality of grinding rolls on its upper face to grind away the rock as the base is rotated and raised by the drill shaft. This drilling method however required a lot of energy, and frequent replacement of the rolls.

It is the object of the present invention to provide a novel method for drilling relatively large holes in hard material, such as rock which method is fast, simple, and relatively inexpensive.

It is another object of the present invention to provide a drill head for use in drilling relatively large holes in hard material such as rock which drill head is relatively simple in construction yet fast and efficient in operation.

It is a further object of the present invention to provide a rock drill employing the improved drill head for drilling relatively large holes.

In accordance with the present invention, it has been found that relatively large holes can be drilled in one pass through hard material, such as rock, by impacting the rock in selected areas to fragment it. It has also been found that the material between the impacted areas will fragment itself by shear. The fragmentation by impact is caused to occur in generally concentric, spiral paths in the face of the rock being worked. The concentric paths are spaced apart leaving rock areas between the paths which are not impacted. However, it has been found that the impacting action in the spiral paths, causes the unworked rock areas between the paths to fragment by shear as the impact tools pass.

The tools for supplying the impacting action can be of any known type of simple power impact tools, such as pneumatic impact hammers. At least two of these tools are employed in a drill head and are operated from the same. More specifically at least two impact hammers are provided in a drill head, the hammers projecting from one end of a support body. The support body has a mounting post projecting from one end, by means of which the drill head is fixed to a drill shaft to be rotated thereby. The impact hammers are generally parallel with the mounting post and the drill shaft and are located at different radial distances from the mounting post. The hammers also project different distances from the support body with the hammer radially nearest to the mounting post projecting the farthest from the support body, the next radially nearest hammer projecting the next farthest, and so on to the hammer farthest radially from the post which projects the least from the support body.

As the drill head is pulled toward the rock surface by the drill shaft, the first impact hammer which is slightly offset from the mounting post and drill shaft and projects farthest from the support body contacts the rock surface first. On rotation and pulling of the drill head by the drill shaft, the first impact hammer when operated starts to carve out a shallow spiral path in the rock about, but spaced from, the drill shaft. The path is carved out by fragmenting the rock by direct impact from the hammer. The rock between the path and the drill shaft is simultaneously fragmented by shear as the hammer rotates. On continued forward motion of the drill head, the second impact hammer comes in contact with the rock face and begins to carve out a second shallow spiral path concentric with the first path but spaced outwardly therefrom. The second path is also carved out by fragmenting the rock by direct impact from the second hammer and the rock between the second path and the deeper first path is simultaneously fragmented by shear as the second hammer passes by.

Additional impact hammers can be employed to provide a hole of the required diameter. Because much of the rock in drilling the hole is removed by shear, much less power is needed to drill the hole than the power used in drilling the same size of hole by grinding. The hole also can be easily drilled in a single pass since all of the rock is not removed by impact.

The method can also be employed to drill sloping or even horizontal holes. In drilling horizontal holes, the drill head can be fixed to a drill shaft carried by a mobile power unit. The mounting post on the drill head projects from one end of the head to be affixed to the drill shaft on the power unit, and the impact hammers project from the other end of the drill head. The power unit both rotates and pushes the drill head against the rock face while the impact hammers are operated.

The invention is particularly directed toward a drill head for use in drilling hard material such as rock, which drill head has support means and a mounting post projecting from the support means. At least two impact hammers project from the support means, the hammers and the mounting post being generally parallel to each other. The hammers are located at different distances from the mounting post. The hammers also project different distances from the support means.

The invention is also directed toward a method for drilling a hole in hard material, particularly rock, comprising fragmenting the material by impact in concentric, spaced-apart, spiral paths and simultaneously fragmenting the material between the paths by shear.

The invention will be better understood with reference to the following description of several embodiments thereof, taken in connection with the accompanying drawings in which.

Figure 1:
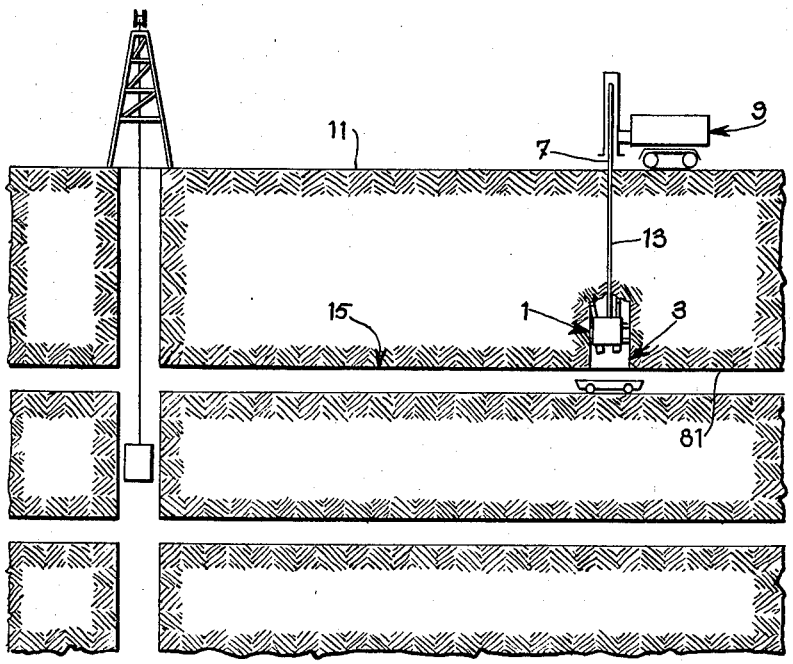
FIG. 1 is a cross-section view of a mine showing a first embodiment of drill unit according to the invention, in in operation.
Figure 2:
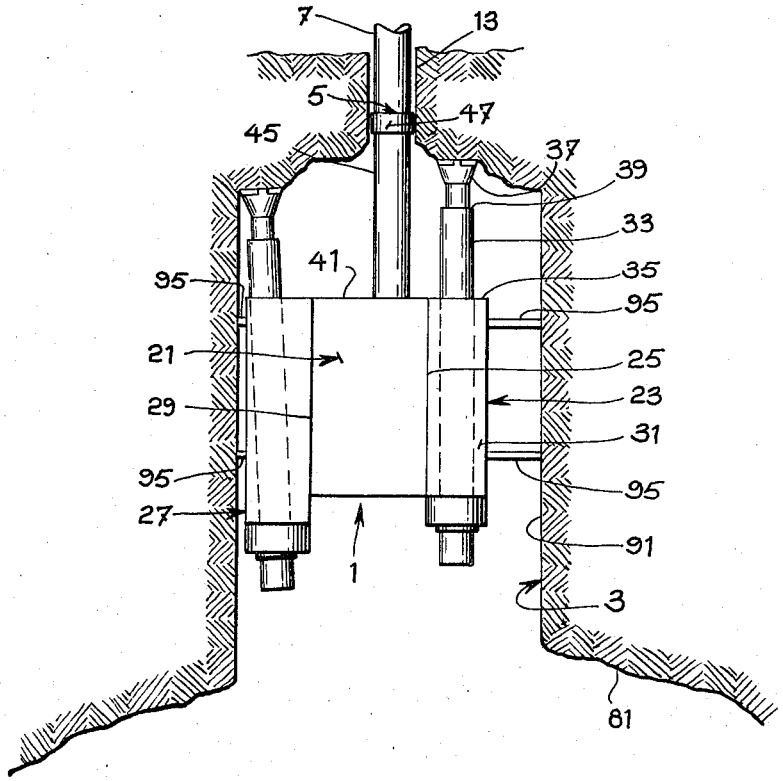
FIG. 2 is a detail view of the drill unit shown in FIG. 1.
Figure 3:
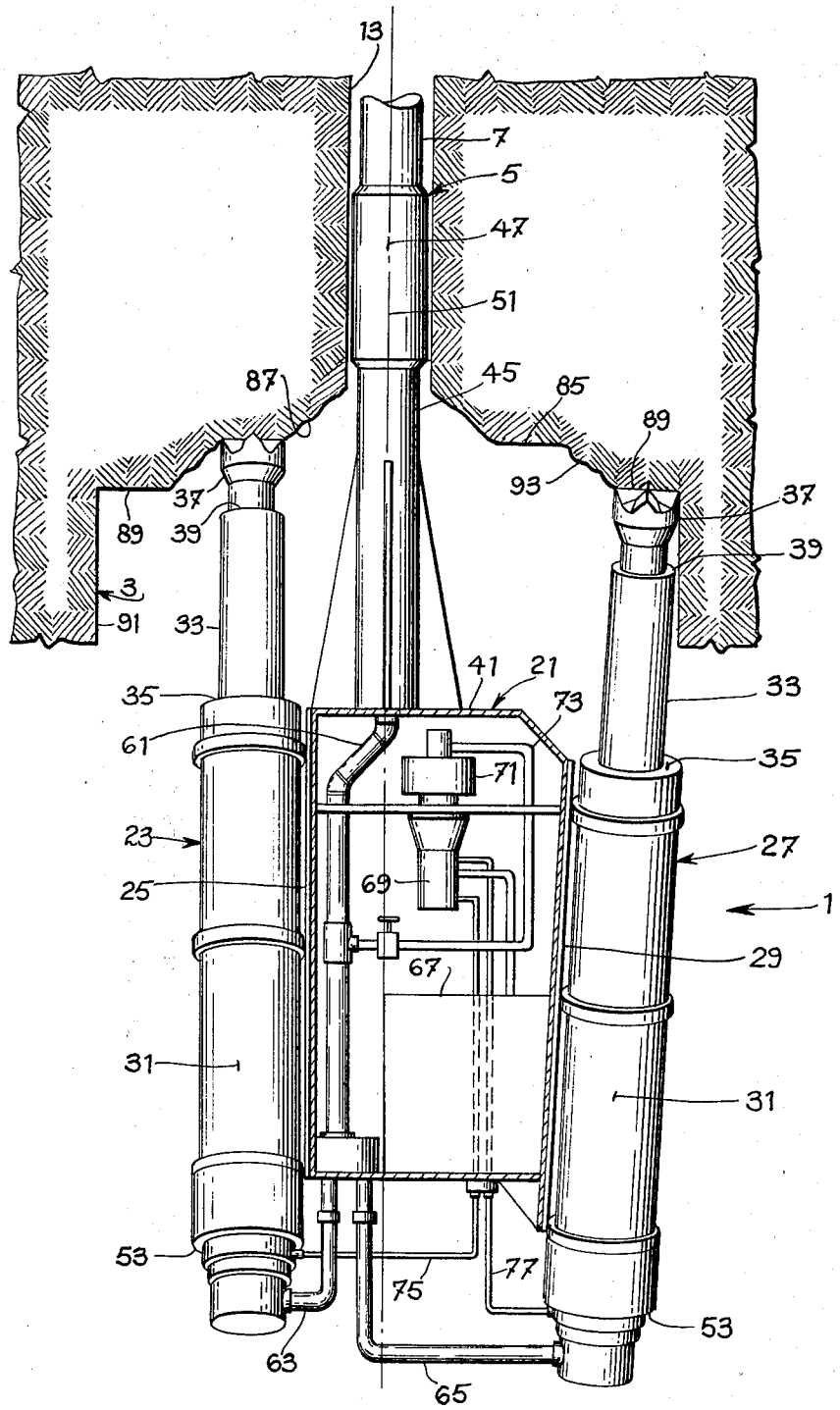
FIG. 3 is a front view of the drill unit shown in FIGS. 1 and 2, in partial section.

FIG. 1 shows, in a general manner, a drilling head 1 adapted to drill generally circular holes. The drilling head 1 can be employed to drill mine ventilating shafts 3 by way of example. As shown in FIGS. 1 to 3, the drilling head 1 is adapted to be attached, by suitable connecting means 5, to a drill rod or shaft 7 operated by a drilling unit 9. The drilling unit 9 can comprise a mobile unit adapted to move into the desired drilling position on the surface 11 above the mine. The drilling unit 9 is used to drill a pilot hole 13 from the surface 11 to a gallery 15 of the mine. A pilot drilling head (not shown) is attached to the drill shaft 7 at the surface to drill the pivot hole 13. Once the drill shaft 7 reaches the gallery 15, drilling is stopped and the pilot drilling head is removed from the end of the drill shaft 7 to be replaced by the drilling head 1.

The drilling head 1 has support means in the form of a main housing 21. A first impact hammer 23 is carried on one side 25 of the housing 21 and a second impact hammer 27 is carried by the other side 29 of the housing 21 opposite one side 25. Both impact hammers 23 and 27 are well known and are of the same construction. They each include a cylindrical housing 31, an impact rod 33 projecting from one end 35 of the housing 31, and an impact head 37 at the free end 39 of the impact rod 33. Both impact rods 33 project past one end 41 of the housing 31. Suitable means are provided within the housing 31 of each hammer for moving the impact rod 33, and the attached head 37 in an impacting manner. While impact "hammers" has been the term employed, any suitable impacting tool for hard material could also be used.

The drilling head 1 has a fixed mounting post 45 extending from the one end 41 of housing 21 by means of which the drilling head 1 is connected, via a connector 47, to the end of the drill shaft 7. The mounting post 45 projects past the impact heads 37 on the impact hammers 23 and 27. The mounting post 45 is connected to the drill shaft 7 is such a manner that they are substantially axially aligned. The mounting post 45 is eccentrically mounted on the housing 21 so that it is closer to the first impact hammer 23 than to the second impact hammer 27. The second impact hammer 27 is approximately twice as far away from the post 45 as is the first impact hammer 23. Both hammers 23 and 27 are generally parallel to each other and to the post 45.

Figure 4:
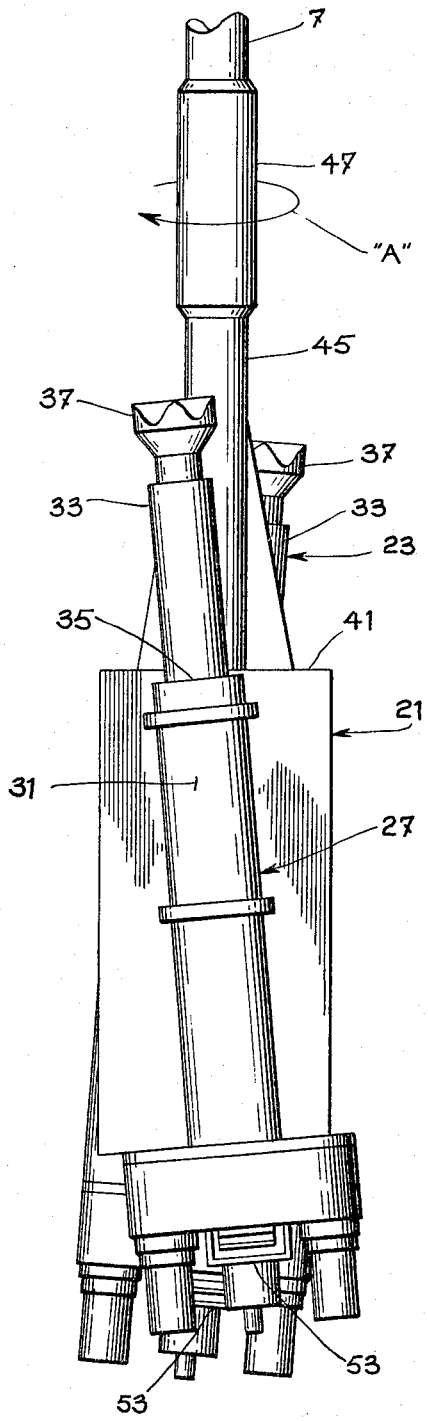
FIG. 4 is a side view of the drill unit shown in FIGS. 1 and 2.

The first impact hammer 23 which is the closest to the post 45, is positioned to project slightly further past the one end 41 of the main housing 21 than the second impact hammer 27. The second impact hammer 27 preferably is tilted outwardly very slightly so that the upper end 35 of its cylindrical housing 31 is slightly farther away from the axis 51 of the mounting post 45 than its lower end 53 as shown in FIG. 3. Also, the two impact hammers 23 and 27 are also preferably tilted slightly in opposite directions so that the upper end 35 of each cylindrical hammer housing 31 leads the lower end 53 of the housing 31 as the drill head 1 is rotated in operation in the direction of arrow "A" as seen in FIG. 4.

A compressed air supply line 61, as seen in FIG. 3, extends fron the drilling unit 9 through the drill shaft 7 and hollow post 45 into the main housing 21. From within the housing 21, branch lines 63 and 65 lead from the supply line 61 to the air motor (not shown) in each of impact hammers 23 and 27 to operate its impact head 37 in impacting fashion. In addition, the drill head 1 has means for rotating the impact heads 37 during use. These means can comprise hydraulic motors (not shown) mounted in the housing 31 of each impact hammers 23 and 27 to rotate the shaft 33 carrying the impact head 37. A hydraulic fluid reservoir 67 is carried in the main housing 21. A pump 69 within the housing, driven by a compressed air motor 71 operated through a branch line 73 leading from supply line 61, provides fluid from the reservoir 67 to the hydraulic motors via lines 75 and 77. The motors for both operating the impact hammers 23 and 27 and for rotating the impact heads 37, are well known.

Figure 5:
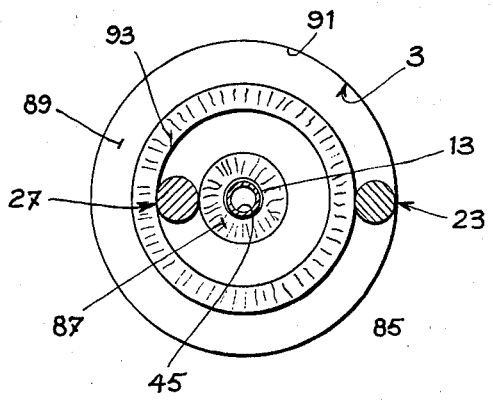
FIG. 5 is a plan view of the drilling pattern.

In operation, after the drilling head 1 has been attached to the drill shaft 7 in gallery 15 via its post 45, rotation of the drill shaft 7 by drilling unit 9 will rotate the drill head 1 about the longitudinal axis 51 of the post 45 and the drill shaft 7. As the drill shaft 7 is rotated, it is also raised to bring the impact heads 37 into contact with the roof 81 of the gallery 15. As the impact heads come into contact with the roof 81, they are operated to both impact, and to rotate about their own axis. The head 37 of the first impact hammer 23, which projects farther from the housing 21 than the second impact hammer 27, comes into with the roof 81 first. While tracing a shallow spiral path about the post 45 as the drill head 1 is rotated, the first hammer 23 cuts out a first inner step 85 in the rock encircling but spaced apart from the post 45. The step 85 is formed by fragmenting the rock by impact. While forming the step 85, the rock material between the hammer 23 and the post 45 is sheared off to form a first roughly sloping surface 87 between the step 85 and the post 45. As the first hammer 23 works its way into the rock, the second hammer 27 comes into contact with the rock approximately out of phase with the first hammer 23. Having the second hammer 27 located diametrically opposite the first hammer 23 helps to balance the forces acting on the drill head. The second hammer 27, while also tracing a shallow spiral path, but of larger diameter than the first path, cuts a second outer step 89 in the rock, spaced from the first step 85 as shown in FIGS. 3 and 5. This second step is also formed by fragmenting the rock by impact. In cutting the second step, the second hammer forms the outer wall 91 of the circular shaft 3 being drilled and also shears off the material between it and the higher inner step 85 to form a second roughly sloping surface 93 joining the two steps.

Since the second hammer 27 slopes outwardly slightly, its impact head 37 forms the shaft 3 large enough to receive the drill head 1. If needed, the drill head can be provided with a pair of spaced-apart rings 95 encircling the housing 21 and 31, as shown in FIG. 2, and fixed thereto. The rings are concentric about the post 45 and serve to retain the drill head 1 in position in the shaft 3 being drilled. The slight forward tilting of the hammers 23 and 27, in the direction of rotation of the drill head 1, provides a slight forward component of force in the desired direction to help fragment and dislodge rock.

The rock that is fragmented by the drill head both by impact and shearing falls down past the head 1 into the gallery 15 where it is collected and disposed off.

Figure 6:
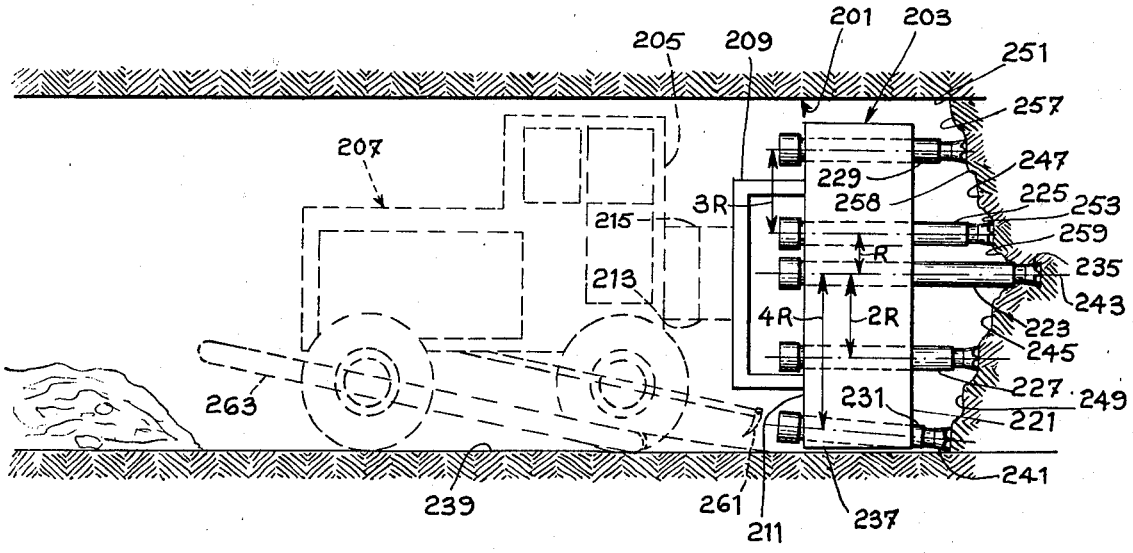
FIG. 6 is a side elevation view of another embodiment of drill unit according to the invention.

The same drilling procedure can be used in drilling a sloping or horizontal hole or tunnel 201 as shown in FIG. 6. In this embodiment, the drill head 203 is fastened to the front end 205 of a movable or mobile power unit 207. The drill head 203 has an attachment bracket 209 projecting from its rear face 211. A mounting post 213 projects from the bracket 209 which post is adapted to be connected to a drive shaft 215 projecting from the front end 205 of the power unit 207. The drive shaft 205 is aligned with the post 213 and rotation of the shaft 215 rotates the drill head 203.

A plurality of impact hammers project from the front face 221 of the drill head 203. Five such hammers 223, 225, 227, 229 and 231 are shown but the number can vary. One of the hammers 223 is axially aligned with the post 213 and projects the farthest from the front face 221 of the drill head. This first hammer 223 drills a central pilot hole 235 for the tunnel 201 as it is operated and moved forward by the power unit 207. The second hammer 225 is radially spaced a first distance "R" from the first hammer 223 and is slightly shorter than the first hammer 223. The third hammer 227 is radially spaced a second distance "2R" from the first hammer 223 and is located opposite the second hammer 225. The first hammer 223 is between the second and third hammers 225, 227 and all three are aligned. The third hammer 227 is slightly shorter than the second hammer 225.

The fourth hammer 229 is radially spaced from the first hammer 223 a distance "3R" and is opposite the third hammer 227. The fourth hammer 229 is slightly shorter than the third hammer 227. The fifth hammer 231 is radially spaced from the first hammer 223 a distance "4R" which distance is almost the approximate radius of the tunnel being drilled. The fifth hammer 231 is opposite the fourth hammer 229 and slightly shorter. The fifth hammer 231 is adjacent the outer edge 237 of the drill head 203 and angled outwardly slightly so that the wall 239 of the tunnel 201 formed by the impact head 241 on hammer 231 is slightly outside the outer edge 237 of the drill head 203. The remaining hammers are substantially parallel to each other and to the longitudinal axis 243 of the tunnel 201.

As with impact hammers 23 and 27, each hammer 223 to 231 is operated by suitable impact motor means carried by the drill head 241. Each hammer is also rotated by suitable rotational means carried by the drill head. Power for the impact motor means and rotational means is supplied from the power unit 207 by suitable means. The power unit 207 is slowly advanced to move the drill head forwardly. As the drill head is moved forwardly and is rotated and as the hammers are operated, the first central hammer 223 drills the central pilot hole 235 by impact fragmentation. The other four drills 225, 227, 229 and 231 follow spaced-apart, shallow spiral paths, each working into the rock to cut a step 245, 247, 249 and 251 respectively by impact fragmentation. The sloping surfaces 253, 255 and 257, between the steps, and the surface 259 between the inner step 245 and the central hammer 233, are formed by shear fragmentation of the rock between the steps as the hammers are operated.

The rock falls to the bottom from where it can be raked by a raker 261, moving past the sides of the drill head, and onto a conveyor 263 carried by power unit 207.

The embodiments of the invention in which an exclusive property or privilege is claimed are defined as follows:

1. A drill head for use in drilling a front of hard material such as rock, said drill head comprising:

support means:

a mounting post secured to and projecting from the support means;

means for detachably connecting said mounting post to drive means for rotating said post and support means and driving said support means towards said front, and at least two impact hammers mounted onto and projecting from the support means toward said front to fragment, in use, the hard material of said front, said hammers being located at different radial distances from the mounting post and having rock fragmenting heads located at different distances from the support means such that the hard material of the front is fragmented by impact along concentric, spaced-apart circular paths and by shear between said paths.

2. A drill head as claimed in claim 1 wherein the impact hammers project from the same end of the support means as the mounting post.

3. A drill head as claimed in claim 2 wherein the impact hammer which is closest to the mounting post, projects the farthest from the support means.

4. A drill head as claimed in claim 3 wherein the outermost impact hammer is tilted slightly outwardly away from the mounting post.

5. A drill head as claimed in claim 1 wherein the impact hammers project from one end of the support means whereas the mounting post projects from another end of the support means which is opposite to said one end, one of said hammers being axially aligned with the mounting post.

6. A drill head as claimed in claim 5 wherein the one impact hammer axially aligned with the mounting post projects the farthest from the other end of the support means.

7. A drill head as claimed in claim 6 including at least three impact hammers, the third impact hammer being located radially about twice as far from the one hammer as the second hammer is radially located from the one hammer, the third hammer projecting the least of the three hammers from the support means.

8. A drill head as claimed in claim 1, 4 and 7 including means on the support means for operating the impact hammers.

9. A rock drill comprising (a) a drill shaft (b) a drill head connected to said drill shaft and (c) drive means for rotating and axially moving the drill shaft and the drill head connected thereto toward a front of hard material to be drilled, said drill head comprising:

support means a mounting post secured to and projecting from the support means means for detachably connecting the mounting post to an end of the drill shaft in axial alignment therewith; and at least two impact hammers mounted onto and projecting from the support means toward said front of hard material to be drilled, said hammers being located at different radial distances from the mounting post and having rock-fragmenting heads disposed at different distances from the support means such that the hard material of the front is fragmented by impact along concentric, spaced-apart circular paths and by shear between said paths.

10. A rock drill as claimed in claim 9 wherein the impact hammers project from the same end of the support means as the mounting post, the hammer which is the closest to the mounting post projecting the farthest from the support means.

11. A rock drill as claimed in claim 9 wherein the impact hammers project from the support means in a direction opposite to the direction of projection of the mounting post, one of said hammers being axially aligned with the mounting post and projecting farthest from the support means, the remaining hammers being spaced at increasing radial distances away from the one hammer, the distance of projection for each hammer decreasing as its radial distance from the one hammer increases.

* * * * *

UNITED STATES PATENT AND TRADEMARK OFFICE

CERTIFICATE OF CORRECTION

PATENT NO. : 4,410,053

DATED : October 18, 1983

INVENTOR(S) : ROGER F. MASSE

It is certified that error appears in the above-identified patent and that said Letters Patent is hereby corrected as shown below:

Column 1, line 15, delete "holes" and insert --hole--.
Column 3, line 3, delete "in" (second occurrence).
Column 3, line 51, delete "is" and insert --in--.
Column 4, line 35, insert --contact-- between "into" and "with".
Column 5, line 5, delete "off" and insert --of--.

Signed and Sealed this

*Twenty-sixth* Day of *March 1985*

[SEAL]

*Attest:*

DONALD J. QUIGG

*Attesting Officer* *Acting Commissioner of Patents and Trademarks*